US005743039A

United States Patent [19]

Garrett

[11] Patent Number: 5,743,039

[45] Date of Patent: Apr. 28, 1998

[54] COMBINATION LOCKING DEVICE FOR FIREARMS

[76] Inventor: John L. Garrett, P.O. Box 253, Longview, Tex. 75606

[21] Appl. No.: 499,401

[22] Filed: Jul. 7, 1995

[51] Int. Cl.[6] ..... F41A 17/00

[52] U.S. Cl. ..... 42/70.11; 42/70.08; 42/42.03; 42/66

[58] Field of Search ..... 42/70.11, 70.08, 42/42.03, 66; 70/286, 332, 288

[56] References Cited

U.S. PATENT DOCUMENTS

| | | | |
|---|---|---|---|
| 3,735,519 | 5/1973 | Fox | 42/70 D |
| 4,014,123 | 3/1977 | Williams | 42/1 LP |
| 4,499,681 | 2/1985 | Bako et al. | 42/1 Y |
| 4,777,753 | 10/1988 | Stancato | 42/70.11 |
| 4,987,693 | 1/1991 | Brooks | 42/70.11 |
| 5,022,175 | 6/1991 | Oncke et al. | 42/70.11 |
| 5,081,779 | 1/1992 | Pack | 42/70.11 |
| 5,171,924 | 12/1992 | Honey et al. | 42/70.11 |
| 5,235,763 | 8/1993 | Nosler et al. | 42/70.11 |
| 5,488,794 | 2/1996 | Arrequin | 42/70.11 |

*Primary Examiner*—Charles T. Jordan
*Assistant Examiner*—Meena Chelliah

[57] ABSTRACT

This invention relates to a combination locking device for controlling existing safety devices on firearms or work independently as a safety on firearms. It is operable to engage and disengage either the existing safety, or act independently to block the firing mechanisms of guns. The invention includes a lock member that will limit access to a firearm's firing mechaniam. The invention is a spring loaded assembly that is totally mechanical. It has an engageable structure that when activated will render a weapon useless. The assembly can be instantly disengaged enabling the authorized user of the firearm to operate the firing mechanism.

7 Claims, 18 Drawing Sheets

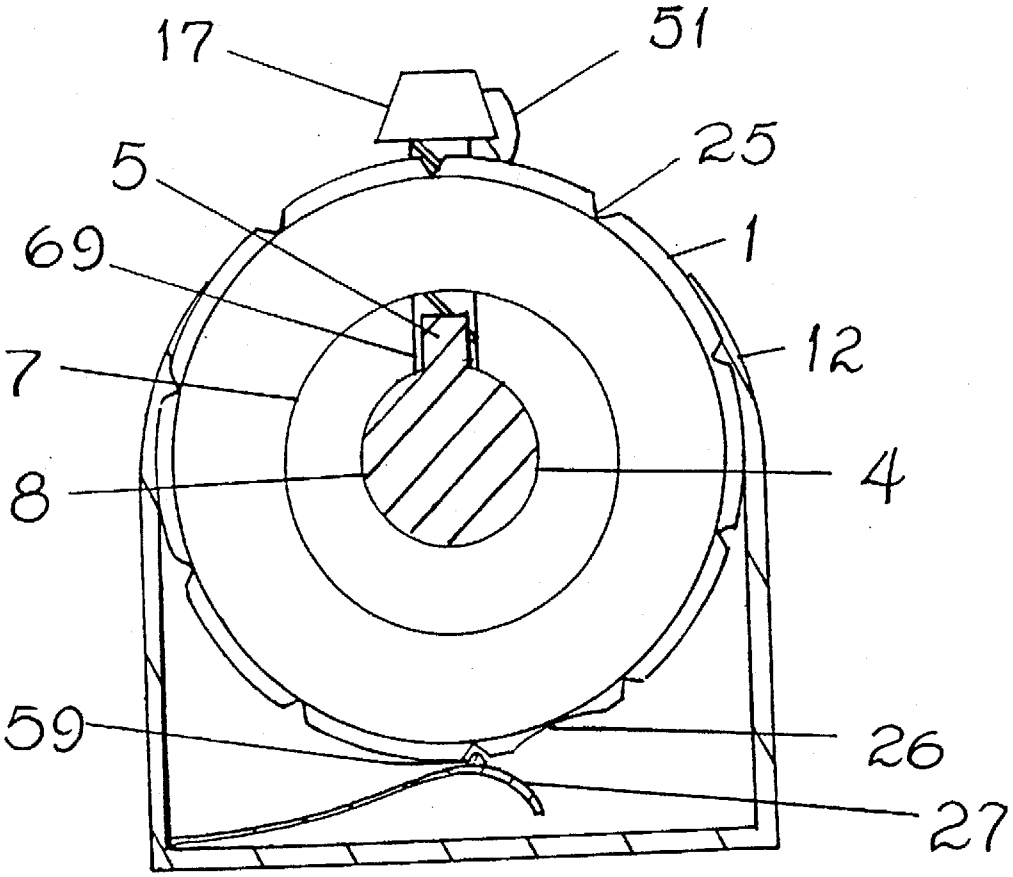
Fig. 11-a

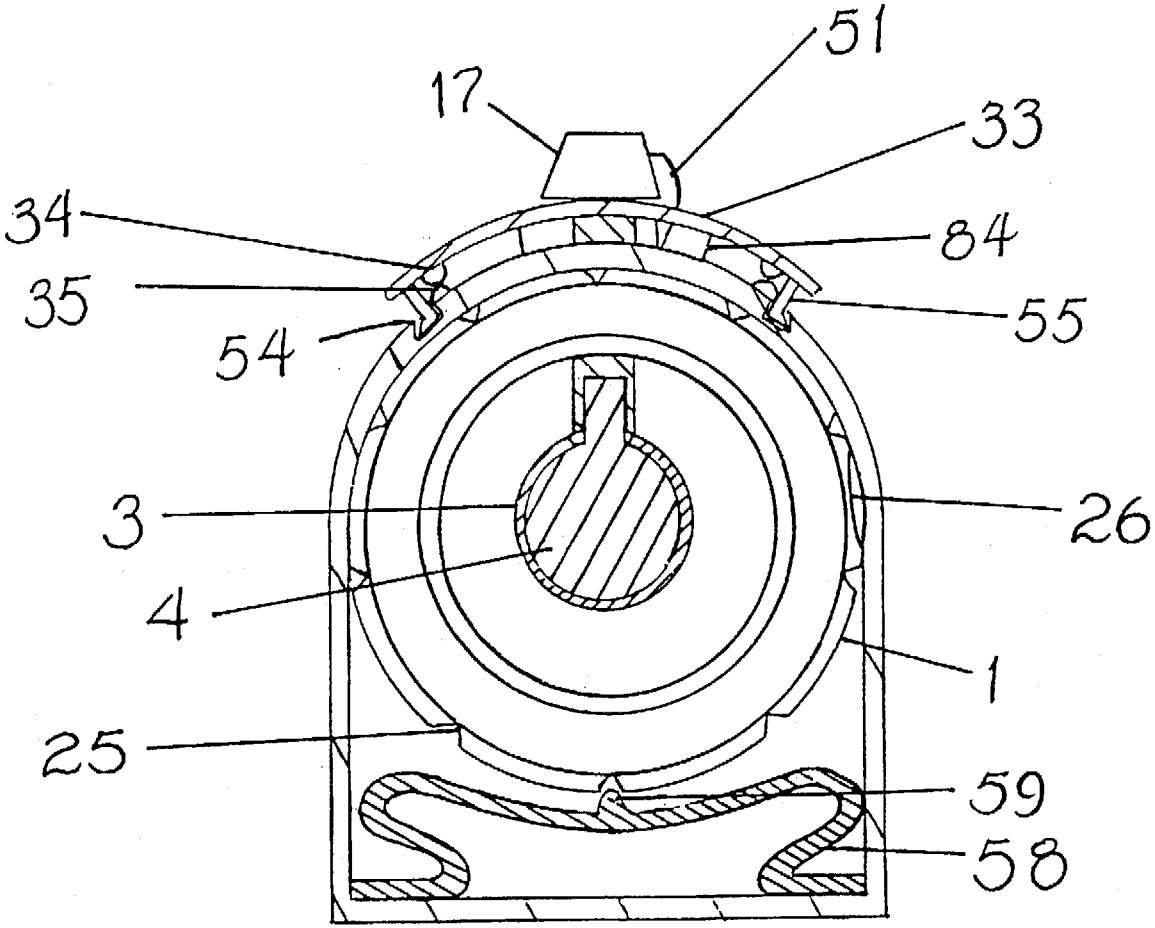
Fig. 11-b

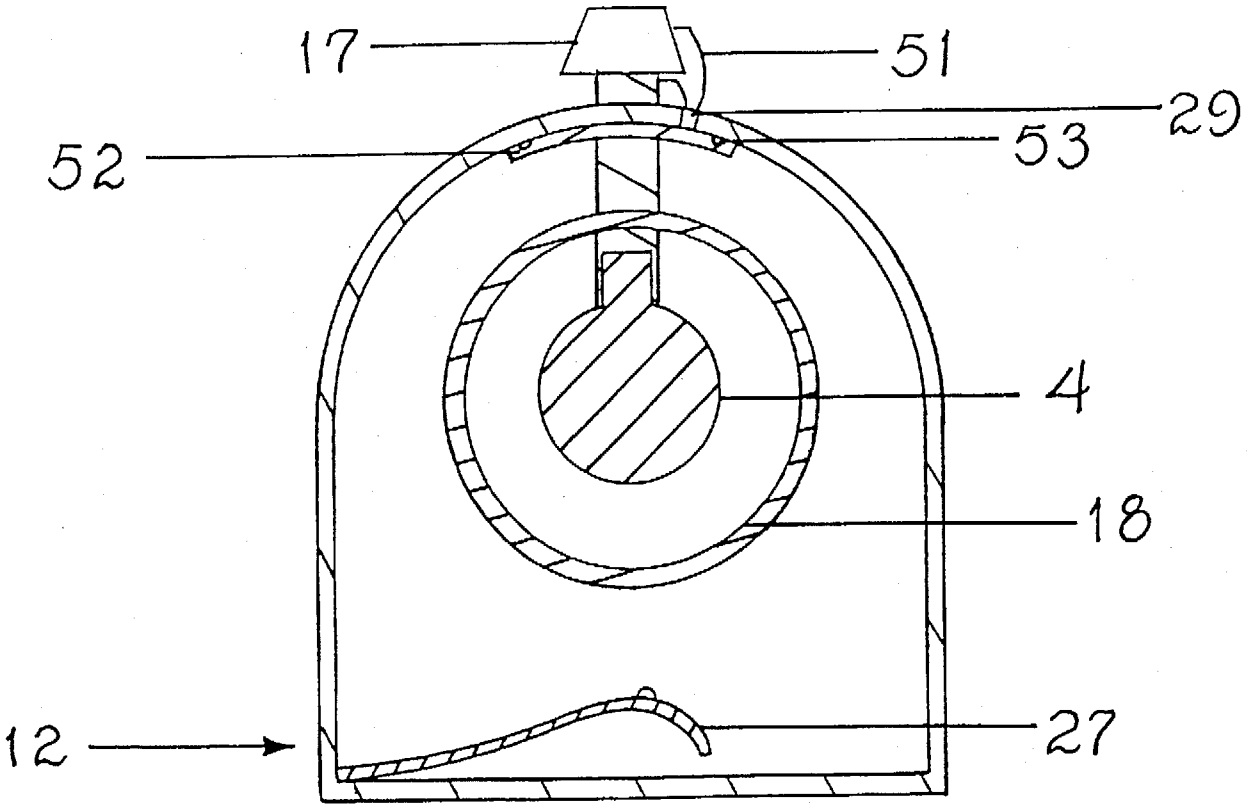
Fig. 11-c

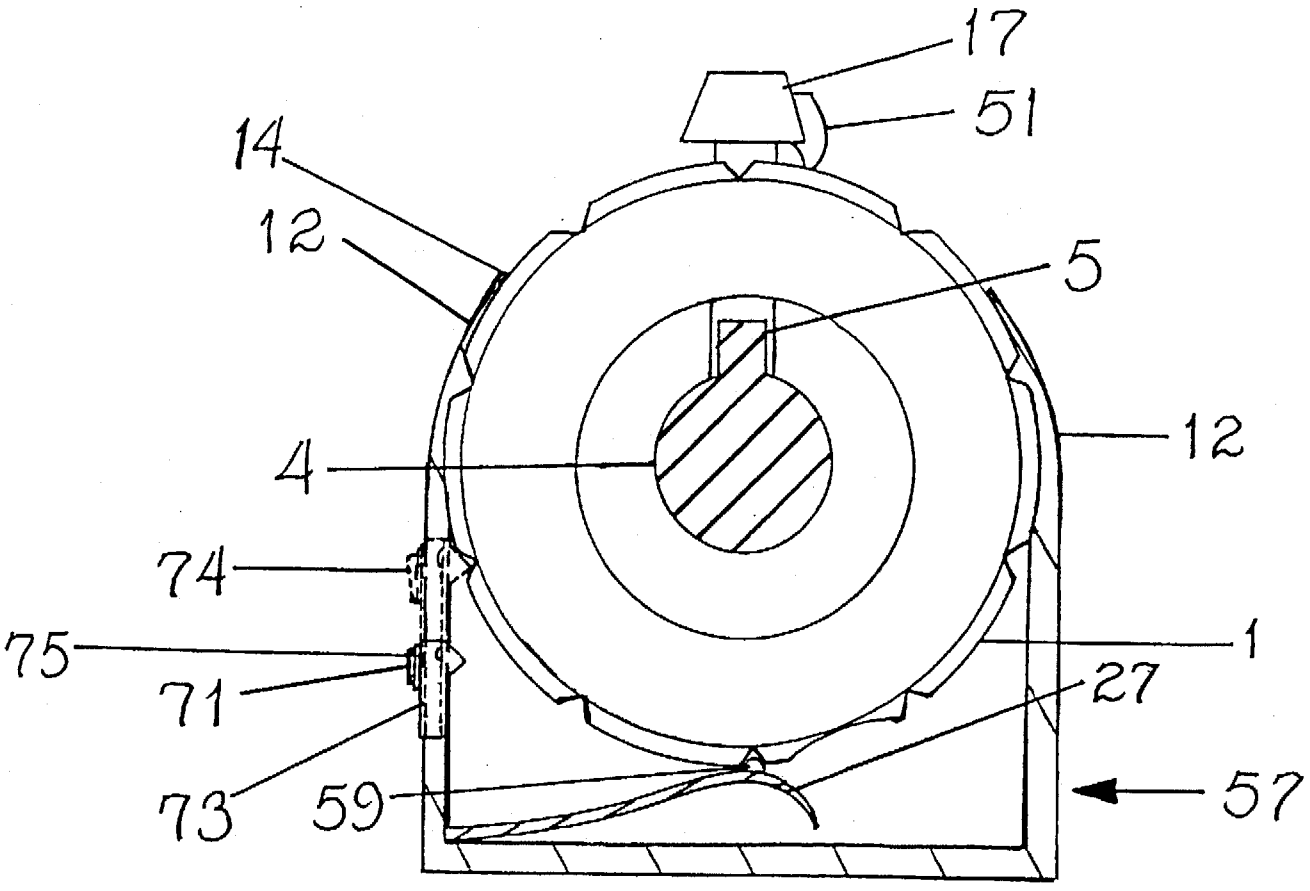
Fig. 11-d

COMBINATION LOCKING DEVICE FOR FIREARMS

BACKGROUND OF INVENTION

1. Field of Invention

The invention relates to a locking device for firearms. More specifically, the present invention relates to a mechanical combination locking device for firearms.

2. Prior Art

Fear of accidental firings and particularity unauthorized use of firearms is growing in our society. At the present time, as in the past, gun safety has been based almost entirely on the "honor" system allowing ALL gun users, authorized or not, to have total control over the use of any firearm that should come into their possession. The disturbing fact that most guns have only a simple "on/off" safety switch while others possess no safety device whatsoever places the public at considerable undue risk. In recent years several new products have addressed this problem. Most of these prior art devices are of two basic types: those utilizing a lock and key system and those employing various types of combination locking mechanisms.

Representative patents of some of these inventions are as follows:

| Name of Inventor: | U.S. Pat. No. : | Issue Date: |
|---|---|---|
| 1. Bako, et al | 4,499,681 | 2/1985 |
| 2. Cervantes | 4,084,341 | 4/1978 |
| 3. Allan | 4,763,431 | 8/1988 |
| 4. LaRue | 4,302,898 | 12/1981 |
| 5. Fox | 3,735,519 | 5/1973 |
| 6. Williams | 4,014,123 | 3/1977 |
| 7. Wallerstein | 4,457,091 | 7/1984 |
| 8. Oncke, et al | 5,022,175 | 6/1991 |
| 9. Heltzel | 4,682,435 | 7/1987 |
| 10. Brooks | 4,987,693 | 1/1991 |
| 11. Brooks | 5,140,766 | 8/1992 |
| 12. McCarthy, et al | 5,392,552 | 2/1995 |
| 13. Parker | 2,327,334 | 8/1943 |
| 14. Pack | 5,081,779 | 1/1992 |
| 15. Arrequin | 5,488,794 | 2/1996 |
| 16. Stancato | 4,777,753 | 10/1988 |
| 17. Honey, et al | 5,171,924 | 12/1992 |
| 18. Nosler, et al | 5,235,763 | 8/1993 |

The above listed patents describe the following types of safety devices:

1. U.S. Pat. No. 4,499,681 issued to Bako et al describes an attachable combination trigger locking device for preventing unauthorized use of firearms. This device incorporates the use of a series of individual cam rollers to operate. While this device can effectively secure the trigger of a firearm, it becomes completely detached in the unlocked mode and can be easily misplaced or lost.

2. U.S. Pat. No. 4,084,341 issued to Cervantes discloses a device that has an attachable trigger locking operation for use in firearms.

3. U.S. Pat. No. 4,762,431 issued to Allan discloses a handgun locking and unlocking apparatus that can be operated by either electronic or mechanical means.

4 U.S. Pat. No. 4,302,898 issued to LaRue shows an individual safety firing button device for firearms.

5. U.S. Pat. No. 3,735,519 issued to Fox discloses a mechanically operated internal cam wheel combination locking device that secures the sear pin for a firearm. This invention operates on the surface by manipulating and selecting a combination of digits in order to lock a firearm.

The preferred invention employs a similar procedure. While this invention allows for the mechanism to lock and unlock a firearm, it does not provide means for effective use in low visibility or when the operator's hearing is impaired as the preferred invention does. Additionally, it does not provide means to return the safety automatically from the "on" position to the "off" position by spring force as the preferred invention also does.

6. U.S. Pat. No. 4,014,123 issued to Williams discloses a safety device comprising a pair of combination lock type dials mounted concentrically and rotatably on a firearm to secure the hammer. While this invention also employs a combination locking device to lock and unlock a firearm, it too lacks the ability to allow effective operation in the dark or in instances when hearing is impaired. This device also has no feature that enables the user to instantly take the gun off safety.

7. U.S. Pat. No. 4,457,091 issued to Wallerstein discloses an electronically programmable key type lock for firearms.

8. U.S. Pat. No. 5,022,175 issued to Oncke et al discloses a battery operated key pad locking device for a firearm located in the handle area. This mechanism requires the correct combination to be entered on an electronic battery powered key pad before the unit unlocks the firing mechanism allowing the user to fire the weapon.

9. U.S. Pat. No. 4,682,435 issued to Heltzel discloses a remote control transmitting and receiving device located on the firearm. This device is battery powered.

10. U.S. Pat. No. 4,987,693 issued to Brooks describes a mechanically operated combination push button locking device for firearms. This type of push button device is apparently designed for a 3 digit combination only. This provides for less than 1000 possible combinations to activate which would require only a minimal amount of time for an unauthorized user to solve.

11. U.S. Pat. No. 5,140,766 issued to Brooks discloses a mechanically operated combination push button locking device for firearms. Both this invention and the other one by Brooks, listed above as No. 10, force the user to depend soley on memory when entering the combination. The user must keep count of the times the buttons are depressed in order to operate the lock. This places an additional strain on the user. It could also be confusing for one to attempt to pre-enter a portion of the combination in order to facilitate faster operation.

12. U.S. Pat. No. 5,392,552 issued to McCarthy et al discloses an electronically operated safety locking device for firearms. This equipment is lighted and battery powered.

13. U.S. Pat. No. 2,237,334 issued to Parker discloses a lock and key device for firearms. This device provides barrel blockage only. The locking mechanism located at the extreme end of the barrel is too large to allow the firearm to be placed in a standard gun holster.

14. U.S. Pat. No. 5,081,779 issued to Pack discloses a lock and key safety device that is mounted inside the grip of a hand firearm. As does the preferred invention, this device employs a plunger rod apparatus to halt the movement of a firearm's hammer. It is a lock and key device located entirely in the gun's handle. The operation is both cumbersome and time consuming, especially when there is difficulty in locating the key.

15. U.S. Pat. No. 5,488,794 issued to Arrequin discloses a device said to be a tamper proof gun lock. This invention employs dummy cartridges and an elongated barrel bore blocker. To disarm this device an ordinary padlock used to connect the bore blocker to the trigger guard must be unlocked or the connecting means must be severed.

16. U.S. Pat. No. 4,777,753 issued to Stancato shows a gun safety that utilizes an apparatus designed to capture a fired projectile. This is a detachable device that is placed at the end of a gunbarrel and locked in place by means of a cam roller combination lock. Much like the above lock and key devices, this invention must be removed from the firearm in order for it to be fired. Because the firearm may be fired in the locked position, this device permits a substantial element of danger.

17. U.S. Pat. No. 5,171,924 issued to Honey, et al discloses a barrel bore blocking device for locking firearms. This invention utilizes a locking wedge that activates a set of locking spurs to block the barrel bore. This system is locked and unlocked by means of a special locking rod. Because this locking rod is detached from the safety, it can be lost or misplaced, thereby rendering the firearm useless.

18. U.S. Pat. No. 5,235,763 issued to Nosler, et al discloses a key operated safety lock that is designed to block the hammer movement of a handgun. To achieve this, the device is supposed to block the movements of either the mainspring strut, the rebound slide, or the hammer strut of a revolver. The locking procedure is dependent on a key that can be lost or misplaced, thereby rendering the weapon useless.

Although most of these and other prior art products are of clever concept and design, none have achieved any appreciable commercial success. Some of the reasons these mechanisms failed to gain public acceptance could be as follows:

a. Questionable reliability: Some of the more recent designs for gun safeties are electronic. These battery powered devices, although elaborate in design, are in constant risk of power failure. Batteries run down over time or become wet and lose all their power. Also, electronic equipment runs the risk of board failure due to misuse or rough treatment in the field. A few of the mechanical devices involve very complex designs with many moving parts that may likewise suffer breakdowns due to rough handling or abuse.

b. Key problems: There is always the dreaded fear that the all important key will either be lost or stolen. Having to spend valuable time in an emergency situation to look for a misplaced key is the same as having lost that key. Also, since the process most often requires the use of both hands to operate, there can be many instances when much valuable time can be lost just fumbling with a key to unlock the gun.

c. Difficult to use: Many of these gun saftey devices are so complicated that they require a considerable amount of time and effort to learn to use. In addition, a clear mind and one's undivided attention are necessary to operate these complex devices. In either case, the utility of these devices are severely compromised.

d: Bulky and cumbersome: Some of the add-on type safety devices can cause a considerable amount of difficulty in handling. This is especially evident when attempting to holster a handgun as the bulkiness of the safety becomes more of a hazard than a safety. Jagged corners, protruding housings and buttons tend to make these weapons cumbersome and difficult to handle even with practice. Because of this, valuable time and accuracy are often compromised.

e. Easily sabotaged: While most of the prior art is relatively tamper resistant there are some designs that can be easily broken into and used by unauthorized persons.

f. Too expensive: Some of the more ambitious are so elaborate that they must be sold at very high prices. A few of the units are so delicate that they require a high degree of operating care. These devices can also be more costly to service and repair.

g. Dangerous operating procedure: Some of the prior art can actually be dangerous to use. For example, one mechanism automatically shuts off after entering the wrong indicia a number of times, thereby forcing the user to find a key to unlock the safety. Although this is undoubtedly helpful in case the weapon is in the wrong hands, it could prove to be dangerous if the authorized user had by chance entered the wrong combination a number of times in a crisis situation and did not have a key handy.

Another design allows for the weapon to be actually fired while the safety is engaged. While the unit is supposed to contain the projectile, it is possible for the entire mechanism to malfunction, causing serious injury not only to the user, but to others as well.

Whatever the precise merits are for these cited references, none of them achieves or fulfills the purposes of the preferred invention.

SUMMARY OF INVENTION

The preferred invention is a cam roller combination safety locking device for guns. It is an assembly designed for heavy duty and made with few moving parts. It is specifically designed for use with personal firearms including handguns, rifles, shotguns, and assault weapons. It can be made with as few as three digitally marked cam rollers. However, this only provides for a minimum amount of security with only 999 available combination choices. It is strongly recommended to have as many of these cam rollers as space will permit up to nine for maximum security. The versatility of the invention is demonstrated by its capability of being installed on existing firearms as well as being designed into the manufacture of new ones.

It is an object of this invention to provide a safety locking device that will render the firearm useless to anyone but the authorized user.

It is an object of this invention to provide a method of operating a safety firearm that is both easy to learn to operate and safe to use.

It is an object of this invention to provide a firearm safety that can be both engaged and disengaged quickly, safely, and securely.

It is an object of this invention to provide a firearm safety device that is durable, tamper proof, heavy duty, and economical to service and repair.

It is an object of this invention to provide a firearm safety device that will be very difficult for anyone other than gunsmiths or well trained persons to alter, reconfigure, disable or otherwise dismantle without causing costly damage to the firing mechanism of the firearm itself.

It is an object of this invention to provide a firearm safety device that is attractive, compact and can be successfully retrofitted to existing firearms as well as being custom designed into the manufacture of new ones.

It is an object of this invention to provide a firearm safety that when properly installed does not interfere with the normal operation of the firearm.

It is an object of this invention to provide a firearm safety device that gives the owner an opportunity to personalize the weapon by using a familiar combination number that is easy to recall such as a driver's license or social security number. By doing this, the owner in the event of theft or loss may stand a better chance of recovering the firearm if it should ever be found. Also, by thus personalizing the weapon, the owner could deter mischievous youngsters, would be-thieves, and criminals from using a stolen weapon.

It is an object of this invention to provide a firearm safety switch that can be used without the aid of light or sound.

It is an object of this invention to provide a firearm safety switch that can be operated by the same hand that operates the weapon without compromising safety, speed, control, or accuracy.

It is an object of this invention to provide a combination safety switch that employs a system whereby a user can easily rotate each cam roller separately without the problem of inadvertently moving other rollers.

Finally, it is an object of this invention to provide a safety switch for firearms that owners will feel confident using. They will be confident they are using the best technology available to preserve their safety, their children's safety and the safety of others.

The preferred invention is suitable for use with existing firearms. It can be retrofitted to adapt to almost any design a particular firearm might have. It would be advantageous for manufacturers to incorporate this invention into the design of new weapons. By doing this, the invention could be so adapted that it would more easily conform to the overall design of the weapon, thereby possibly conserving space and providing the means for easier and smoother operation.

Too many times do we see that some child was killed while playing with a firearm or that some hoodlum went on a killing spree with a stolen gun. This invention can help curb these tragic situations. It is now time for this invention to be put to use.

DESCRIPTION OF DRAWINGS

The basic embodiments of the preferred invention are shown in the following drawings. These drawings are intended to show the design concept and features only. They are not drawn to precise scale as to readily fit any particular firearm. While these drawings show fundamental designs as outlined in the detailed description of the preferred invention, they do not limit the invention to these particular arrangements alone.

FIGS. 9 and 9*a*–9*c* are four views of a preferred cam roller.

FIGS. 11*a*–11*d* are four cross section end views of a preferred combination lock.

DESCRIPTION OF PREFERRED EMBODIMENT

Figure 1:
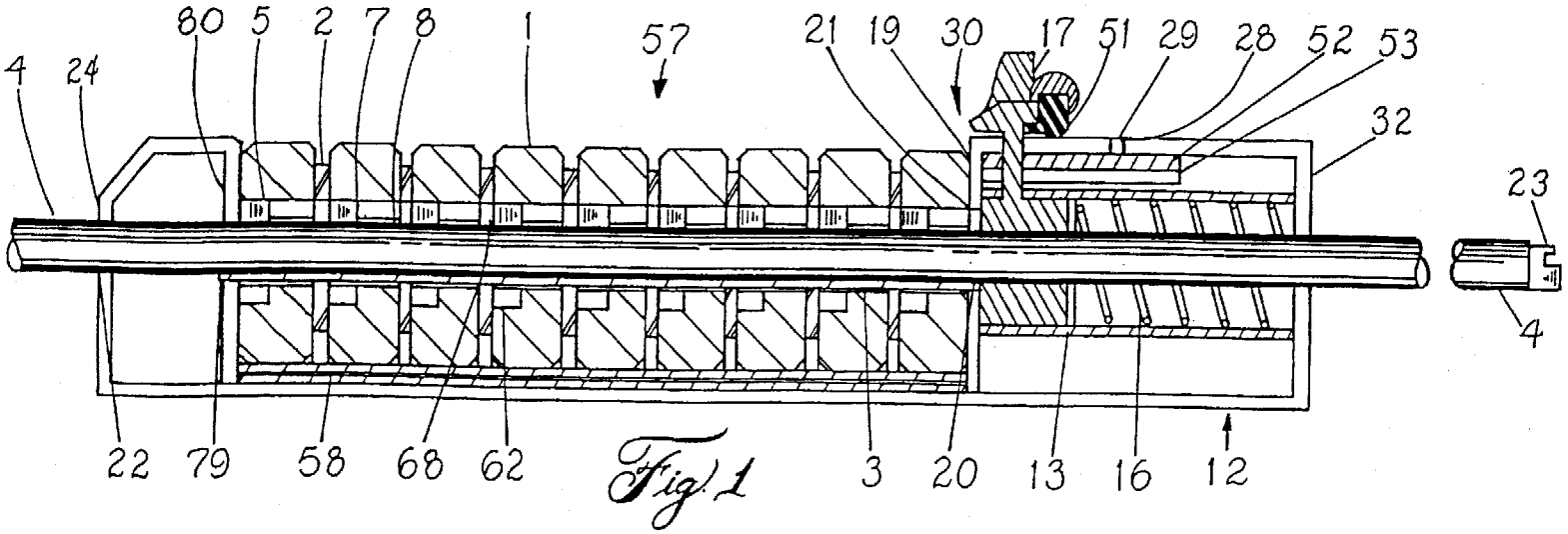
FIG. 1 is a cross section side view of a preferred combination lock.

Referring to FIG. 1, a preferred invention assembly (57) shows an improved cam roller assembly (10) concentrically set within a rectangular cylindrical housing (12). This housing (12) has two compartments. The first one contains the cam roller assembly (10). The other compartment contains the plunger rod spring assembly (13). The cam roller assembly (10) consists of a plurality of improved digital cam rollers (1) of known construction, each containing a female notch (7) crowning a recessed centered donut hole (8). These cam rollers are independently set for rotation between spacers (2), each containing a female notch (68) above a donut hole opening (69) concentrically mounted in series on an improved known plunger rod member (4) with corresponding male notches (5) mounted peripherally in series. This assembly (10) may be permanently ajoined to the invention housing (12) by attaching the individual cam roller spacer members (2) with attachment members (15) adapted to and extending outward perpendicularly from the said individual cam roller spacers (2) to the housing of the invention (12). This means (5) can often be most preferrable with installations in certain pistol handles (39).

Figures 9, 9A:
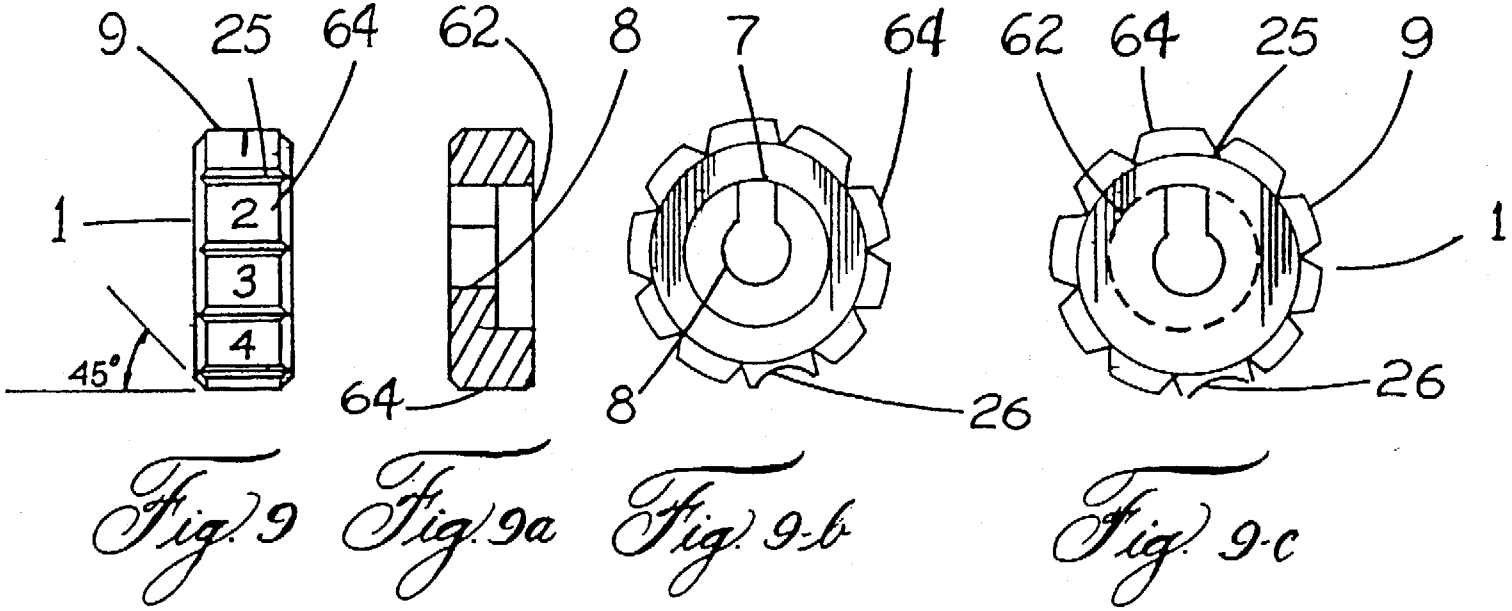

Another means of securing the cam roller assembly (10) to the invention housing (12) is to fuse the cam roller spacers (2) concentrically along with the two stationary partition walls (19 & 80) to a slotted tubular support member (3). The plunger rod member (4) is concentrically set inside so that it is horizontally movable only back and forth with only its peripherally mounted male notches (5) protruding through the slotted groove of said slotted tubular support member (3). The female notched opening (7) above the recessed centered donut hole opening (8) of the individual cam rollers (1) is directly below the assigned indicia space (9). The concentric recess (62) of the centered donut hole (8) on each cam roller (1) is approximately one half the depth of the donut hole (8) with a radius extending to the height of the female notch (7) (see FIG. 9). The peripherally mounted male notches (5) are aligned on the plunger rod (4) to rest beneath these recesses (62) when the invention (57) is either in the locked (31) or unlocked (30) position. The cam rollers (1) in aligned arrangement may rotate freely over and around the plunger rod (4) and notches (5) only when either in the locked (31) or unlocked (30) position. The spacer members (2) each containing a donut hole (68) crowned with a female notch (69) are immovably set in the slotted tube member (3) between the individual cam rollers (1). The female notches (7) of the cam rollers (1) and the female notches (69) of the spacers (2) are large enough to clear the male notches (5) on the plunger rod (4) as it glides back and forth. This can only be done when the correct combination is entered on the cam roller assembly (10). The invention housing (12) contains a slotted opening (14) approximately 3 digit's width (9) wide and as long as the combined width of the cam roller group (10). This will provide the user room to easily view and manipulate the cam rollers (1).

The other compartment of the invention housing (12) houses the plunger rod spring assembly (13). The plunger rod spring (16) is placed embracing the plunger rod (4) in the spring housing compartment (18) where it fits snugly between the control means (17) and the plunger rod spring housing end (32) of the invention housing (12). The two said compartments are separated by a stationary plunger rod spring partition wall (19) in the invention housing (12). This wall (19) has a donut hole in its center (20) crowned by a female notch (21) consistent with the apertures of the cam rollers (1) and the spacers (2).

Figure 3:
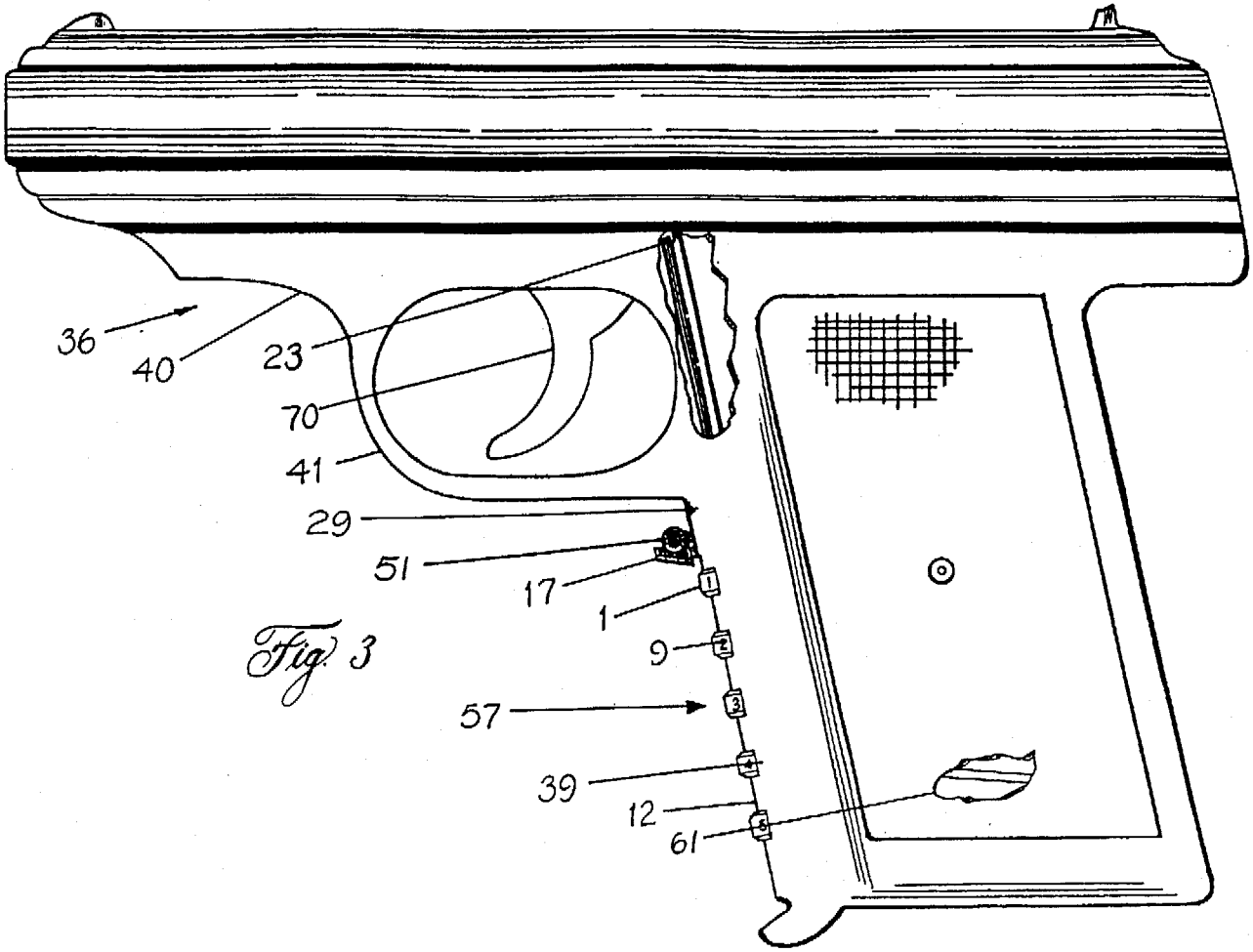
FIG. 3 is a preferred combination installed on a semi-automatic pistol.
Figure 10:
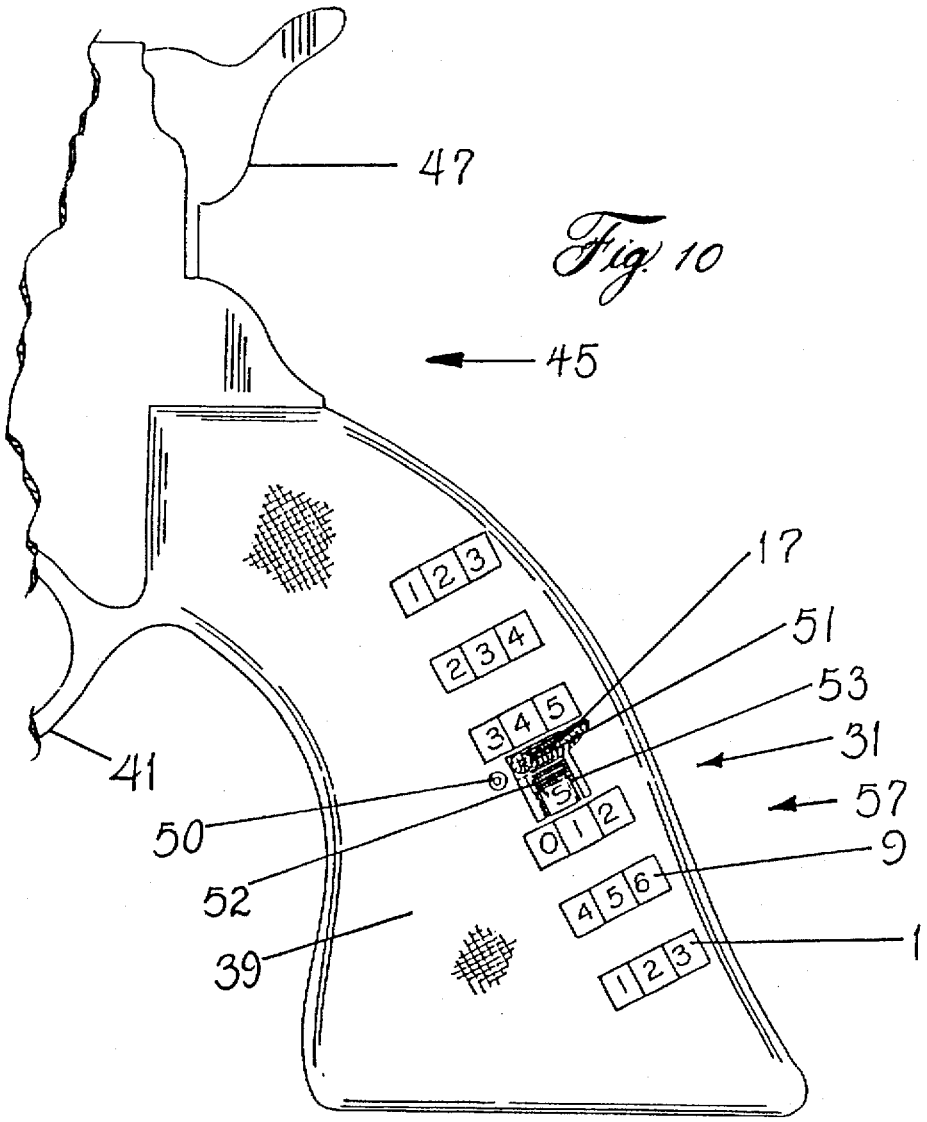
FIG. 10 is a cross section view of a preferred combination lock installed on a revolver.

The plunger rod member (4) extends horizontally through the entire invention housing (12). It protrudes through a centered donut hole opening (22) on the aft end (24) of the invention housing (12), through the aft end partition wall (80), through the cam roller assembly (10), through the plunger rod spring partition wall (19), through the plunger rod spring assembly (13), and through the plunger rod spring end of the housing (32) terminating at a point where it joins the blocking member (23) that blocks the firing device of the weapon. This assembly is the plunger blocking group (65) and is only movable back and forth when the correct combination of indicia is in place on the cam roller group assembly (10). The location and design of the blocking member (23) will conform to whatever type blocking device member is needed for each particular firearm. For example, on a certain type pistol (36) as seen in FIG. 3, the blocking member (23) could be attached at the end of the plunger rod member (4) where it comes in contact with the trigger draw bar (37). The blocking member (23) for a common type of revolver (45), however, might be best placed protruding perpendicularly from the plunger rod member (4) at a point approximately at the middle of the invention housing (12) to block the hammer spring rod (48). A sample of one of these type installations is shown in FIG. 10.

On the peripheral circumference face (64) of the cam rollers (1) are small perpendicular "v" shaped indentions or humps (25) of known uniform design evenly set between each digit space (9) with only one significantly larger one (26) placed in one of these locations. All of these markings (25) are of sufficient size and shape that when they are turned they will cause a cadence when they come in contact with an elastic member (42) abutting the cam roller assembly (10). This elastic member (42) can be characterized by a leaf type spring (27) that would provide spring resistance to each cam roller (1) either independently or in group. It can also be characterized by a humped flat spring member (58) placed horizontally below and abutting the circumference face (64) of the cam rollers (1) either independently or in group. This circular, elongated hump (59) on said spring member (58) has a diameter approximately the same width as the perpendicular markings (25) on the cam rollers (1). It can be adapted to fit horizontally to the flat spring member (58) and provide pressure to each cam roller individually. It can also be adapted to fit horizontally to the flat spring member (58) by extending the entire length of the cam roller group (10). A constant mild pressure against the cam rollers (1) is exerted by this elastic force. The larger indentation or hump (26) on the cam roller (1) is for reference only and will cause a variance in the cadence when it comes in contact with the cam roller elastic member (42). This cadence can be both felt and heard. This enables the user to know exactly where the indicia (9) are even when dialing them in the dark or in instances when the cadence cannot be heard.

The safety control switch means (17) is securely fastened perpendicularly to the plunger rod (4) at the approximate point in the invention housing (12) just between the inside housing partition wall (21) and the plunger rod spring (16). This control member (17) is attached to a slidably curved plate member (52) and protrudes through a horizontal control means slot (28) in the invention housing (12) that extends to the mid section of the plunger rod spring compartment (18). There is a catch member (29) located at this point on the housing (12). An elastic secure member (51) is attached peripherally to the control means (17) to provide a constant force against the invention housing (12).

In order to lock the weapon, the user must enter the correct combination of indicia on the cam roller assembly (10) then move the control member (17) and secure member (51) together through the control means slot (28) to the locking position (31), thereby compressing the plunger rod spring (16). Then the elastic force of the secure member (51) will engage the control member (17) with the catch member (29), thereby locking the firing means of the weapon. For an example of this, refer to FIG. 3 showing the blockage of a pistol's trigger draw bar (37). To complete the locking procedure the combination is then scrambled by cam roller rotation (1) to prevent unauthorized persons from using the weapon (36) or learning the combination.

To unlock the firing mechanism, the user enters the correct combination of indicia on the cam roller group (10) to free the control member (17) so it can be moved. The user then moves the control member (17) away from the locked position by pushing the secure member (51) out of the grasp of the catch member (29). The force of the now released plunger rod spring (16) causes the control member (17) and the attached secure member (51) to instantly slide through the control means slot (28) to return to the unlocked position (30). The weapon is now ready to fire. The combination should now be rescrambled.

In order to effectively protect and seclude the inner structure of the plunger rod spring assembly (13), the control member (17) and the securing member (51) are secured to the above mentioned slideably curved plate member (52). This member (52) is concentrically placed in two parallel grooved tracks (53) horizontal to the housing (12) and directly below the control means slot (28).

The plunger rod (4) is secured at a point (determined by the firing arrangement of whatever weapon it is to be installed in) to a blocking member (23) specially made for that particular type of weapon. Of course, the means of linking these two members when being manufactured into new weapons can be as simple or complicated as manufacturer desires. The installation cited above discloses a simple, yet very effective, direct blockage of a trigger draw bar (37) of a selected pistol (36). On the other hand, newly manufactured weapons can be designed with more sophisticated linkups to this invention (57) controlling multiple safety blocks. For example, the invention (57) could be so linked that it could block the trigger draw bar (37), the sear (63), and hammer (47) all in one operation.

An optional sliding curved cover (33) can be placed over the viewing area of the cam roller assembly (10). It is glidable back and forth horizontal to the housing (12) on two parallel rails (55). The slide rails (55) glide in two parallel tracks (54). This sliding cover (33) has indentions (34) next to its slide rails (55) that correspond with humps (35) on both sides of the cam roller slotted opening (14) of the housing (12). The slide rails (55) are located along the horizontal sides (67) of the sliding cover (33). The parallel tracks (54) are horizontally placed on both the long sides of the slotted opening of the housing (14). This cover (33) extends the length of the cam roller assembly (10). It has perpendicular slots (82) that reveal every other cam roller (1) in sequence. This cover (33) is only movable one slot space (82) horizontally back and forth over the cam roller assembly (10). This back and forth movement is contained by protruding end stops (83 & 84) on the housing (10) fore and aft. The indentions (34) and humps (35) placed along the track (54) serve as slot stops for the sliding cover (33). This extra feature helps speed up the manipulation proces and can prevent unauthorized persons from viewing the combination.

Figure 15:
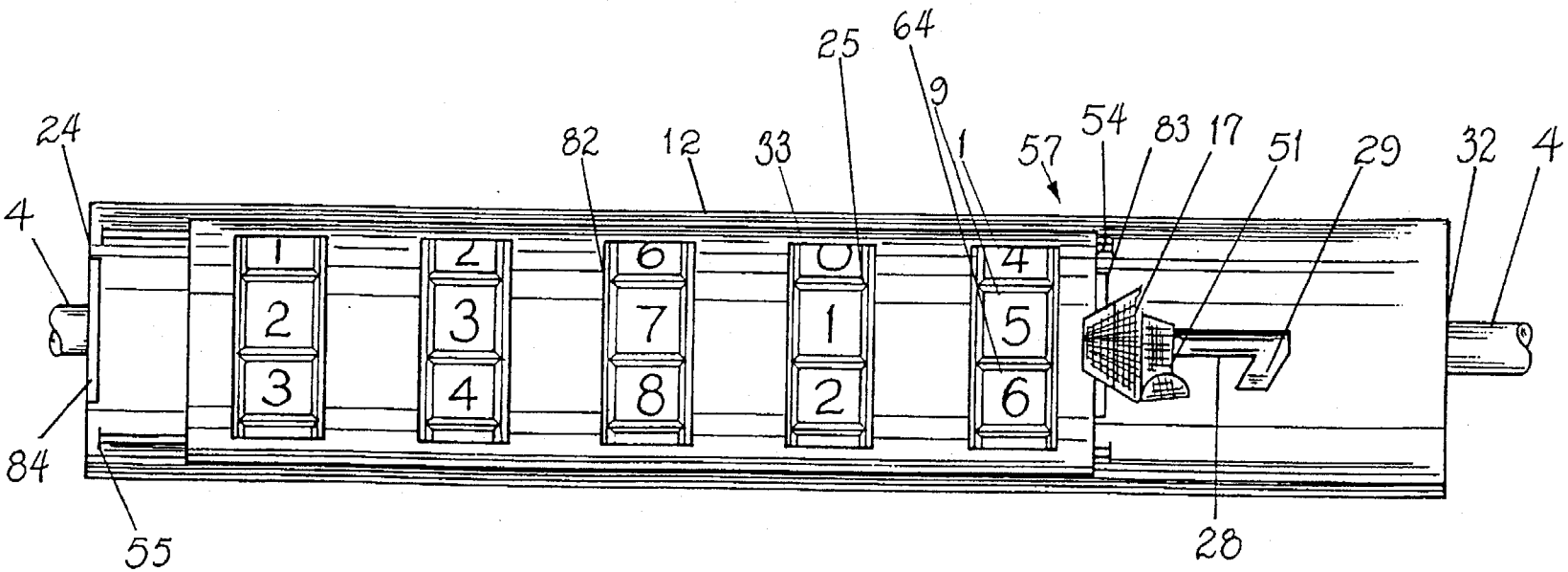
FIG. 15 is a top view of a preferred combination lock.

As seen in FIG. 15, a cam roller resistance button system (77) is used to aid in the manipulation process. This system (77) consists of a series of individual resistance buttons (71). They each are movable on parallel rails (78) glidable on two corresponding parallel tracks (73). The assembly (77) is in allignment with and slidably parallel to the cam roller assembly (10). Each resistance button (71) is set so that it can only move back and forth, vertically parallel to each cam roller. When this engagement (74) occurs, the resistance button (71) will abutt its corresponding cam roller (1) thereby halting its rotational movement. The user may engage all the resistance buttons (71) except the particular button (71) that is next to the object cam roller (1) that is being rotated in order to avoid inadvertently moving other cam rollers (1). When the rotation of a cam roller (1) has been completed, the user may then place said resistance button (71) in the engaged position (74) and proceed with the rotation process by repeating this same manuever using a different cam roller (1) by disengaging its corresponding resistance button (71). This process is repeated on the other cam rollers (1) until the entire combination selecting process has been completed. When the correct combination is entered on the cam roller assembly, all of the resistance buttons, (71) are to be placed in the engaged position (74). The control member (17) can now be moved to change locking positions. After the locking process is completed, the resistance buttons (71) can all be placed in the unengaged position (76) so that the cam roller assembly (10) can be rescrambled.

Figure 2:
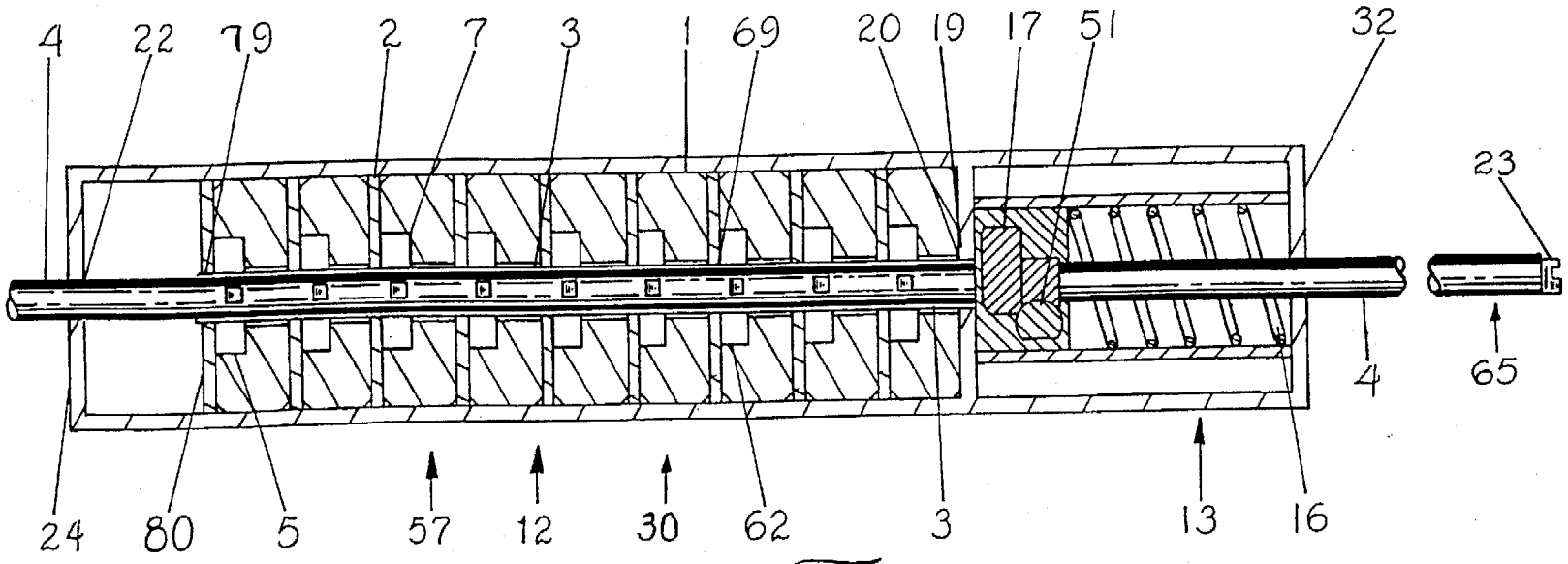
FIG. 2 is a cross section top view of a preferred combination lock.
Figure 5:
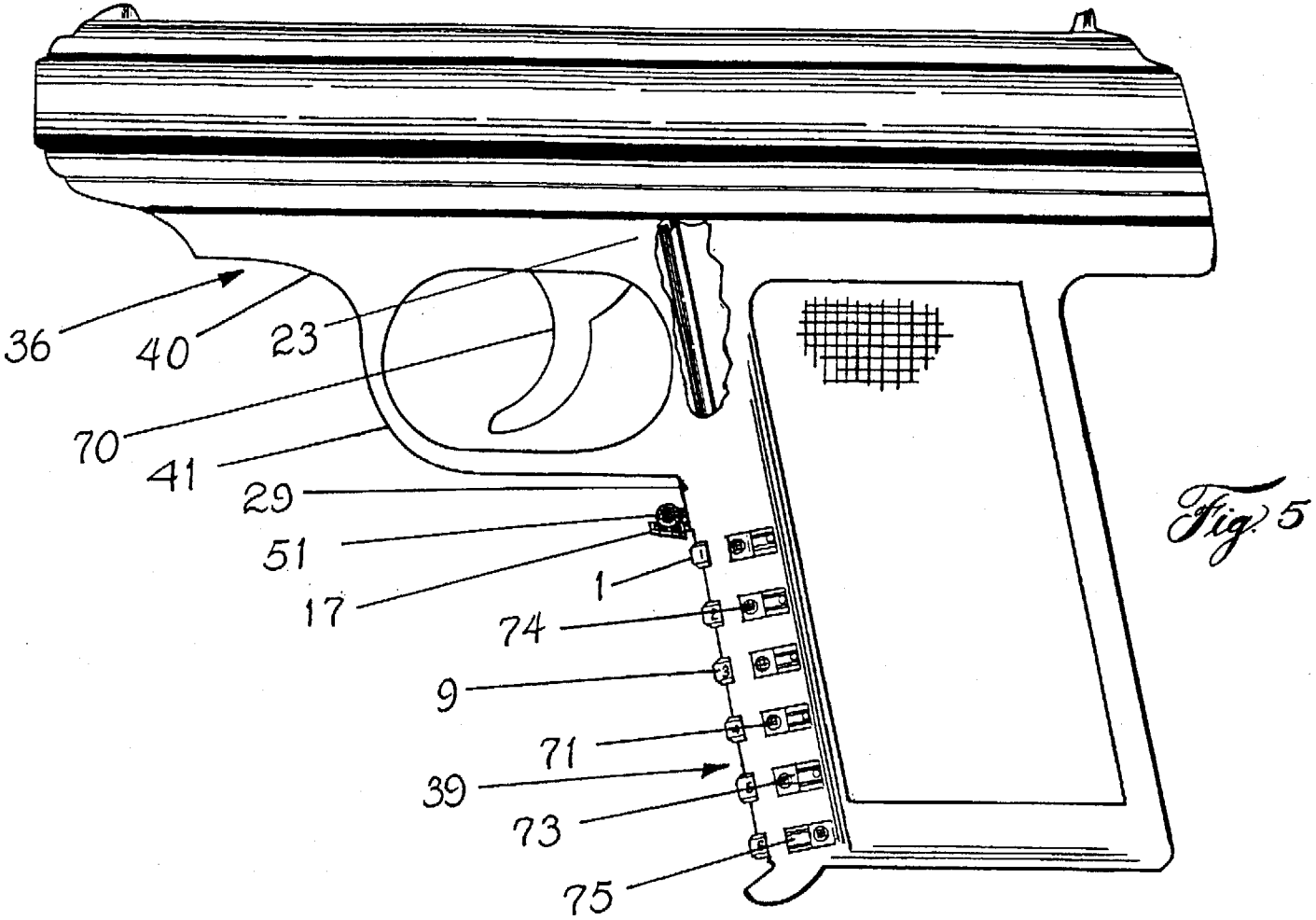
FIG. 5 is a view of a preferred combination lock installed with resistance buttons on a semi-automatic pistol.
Figure 6:
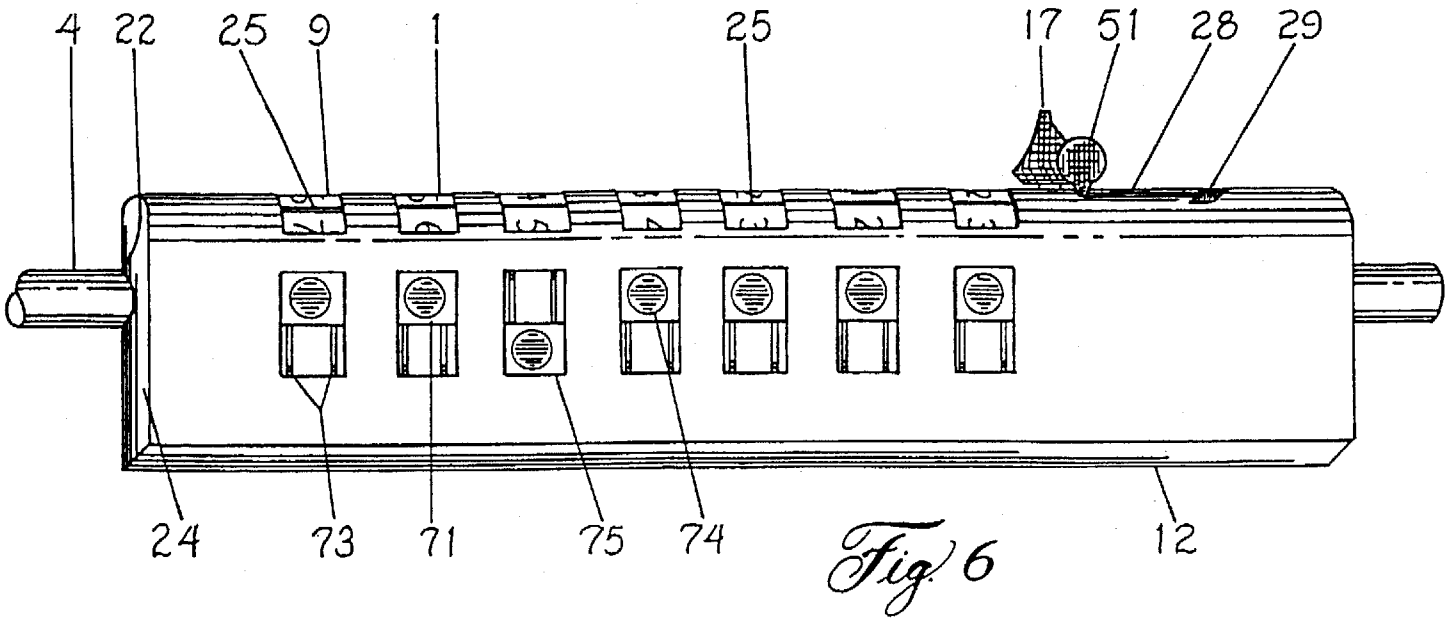
FIG. 6 is an isometric view of a preferred combination lock with resistance buttons.
Figure 7:
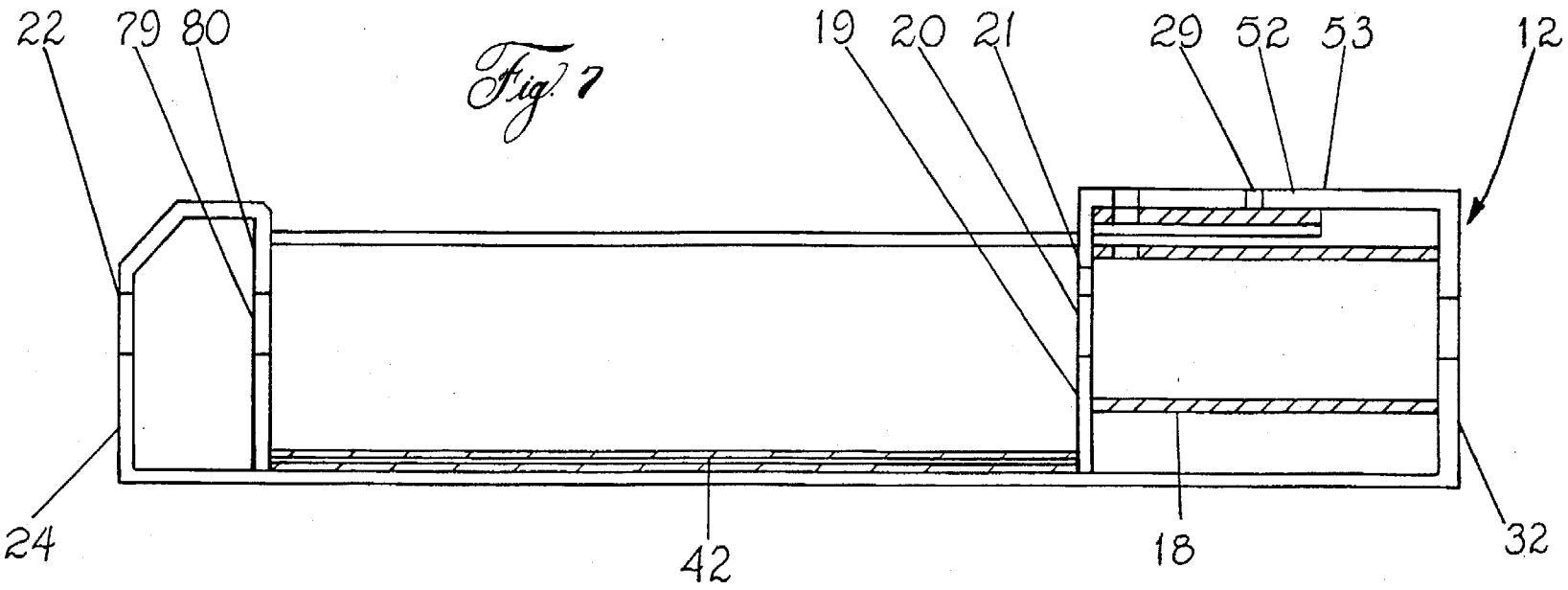
FIG. 7 is a cross section view of a preferred combination lock housing.

The resistance button assembly (77) as described above is shown in FIG. 2 installed on the invention housing (12) and in FIG. 5 installed on a pistol (36). This type of system (77) can be installed on other members of other weapons as well.

Figure 8:
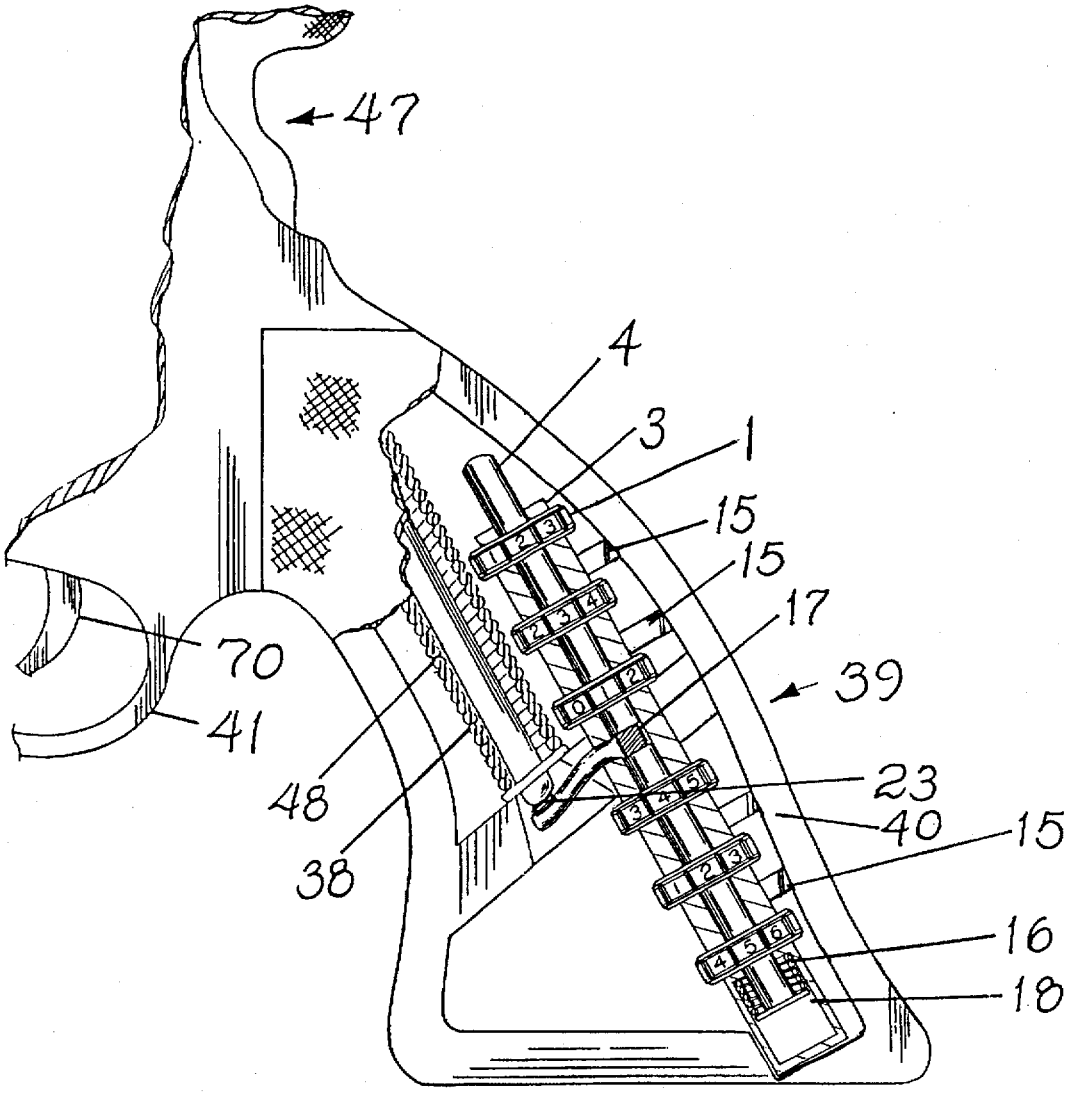
FIG. 8 is a side view of a revolver with an installed preferred combination lock.
Figure 12:
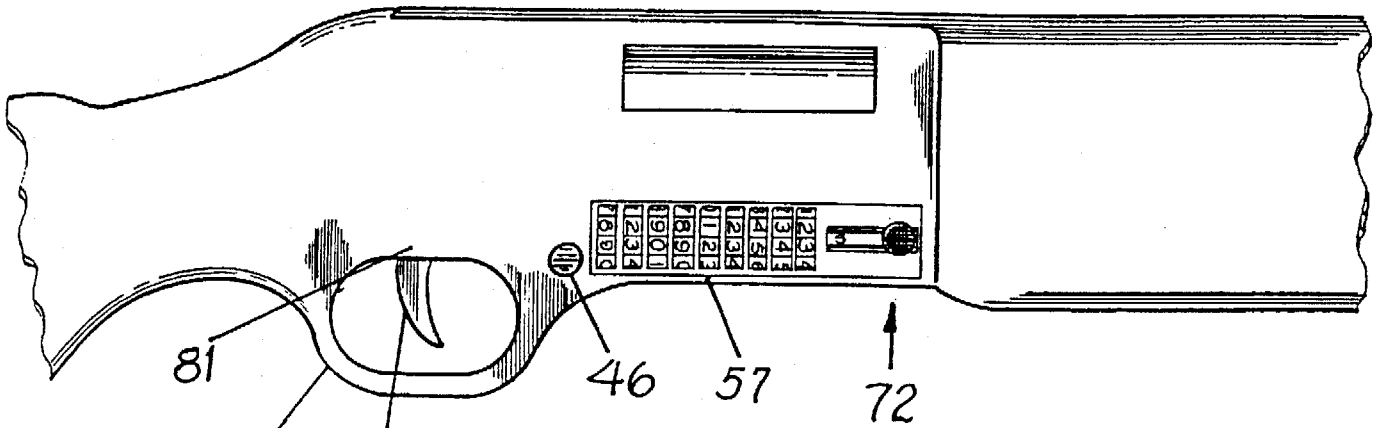
FIG. 12 is a side view of a preferred combination lock installed on a shot gun.
Figure 13:
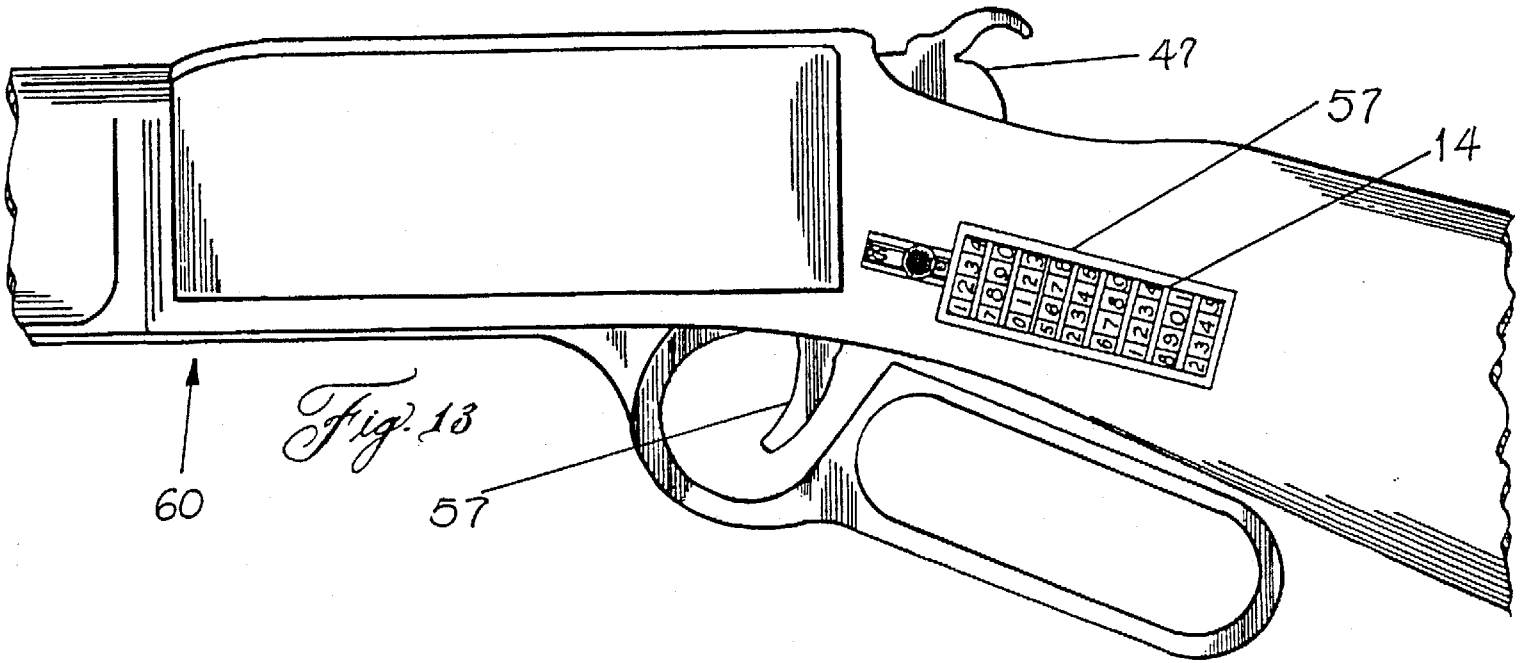
FIG. 13 is a side view of a preferred combination lock installed on a rifle.
Figure 14:
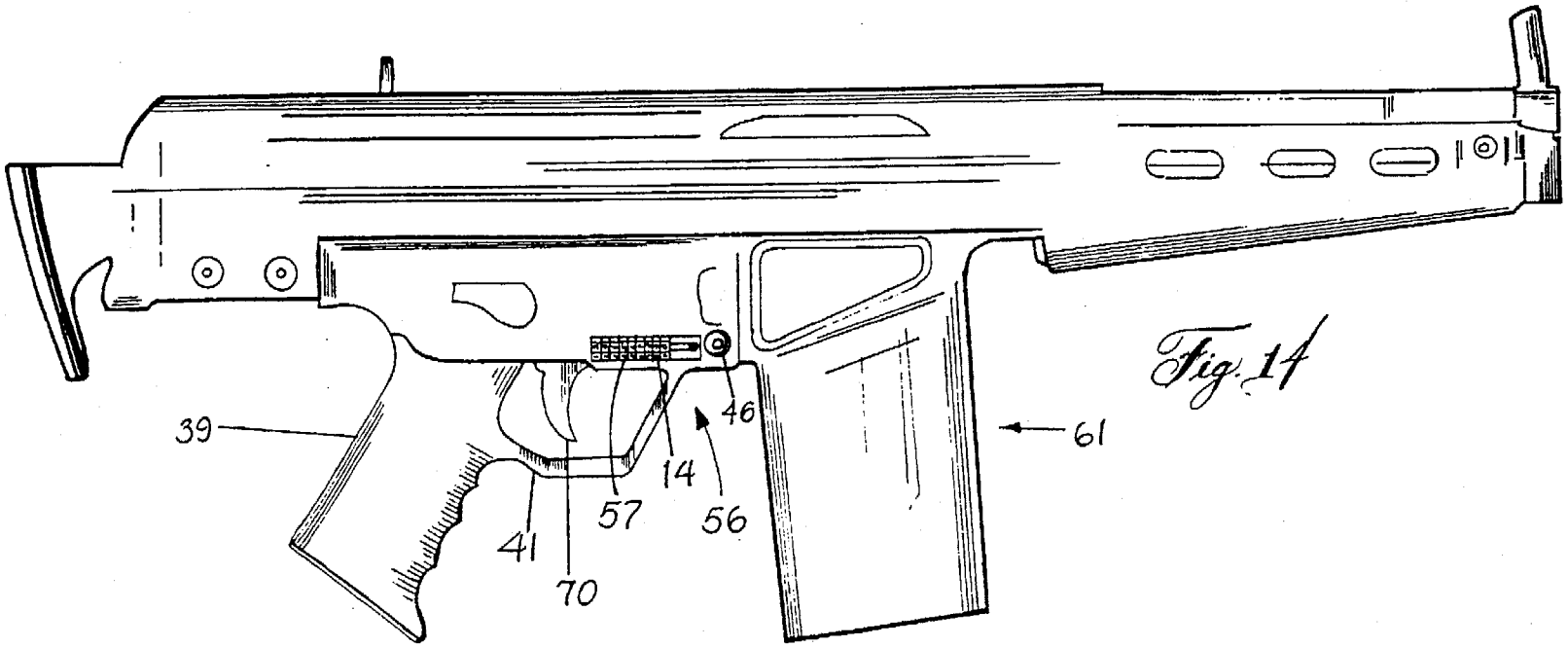
FIG. 14 is a side view of a preferred combination lock installed on an assault weapon.

FIGS. 8 and 10 show the invention (57) as installed on a revolver (45). FIGS. 12 through 14 show the invention (57) installed on a rifle (60), a shotgun (61), and an assault weapon (76) respectively.

Pistols

Figure 4:
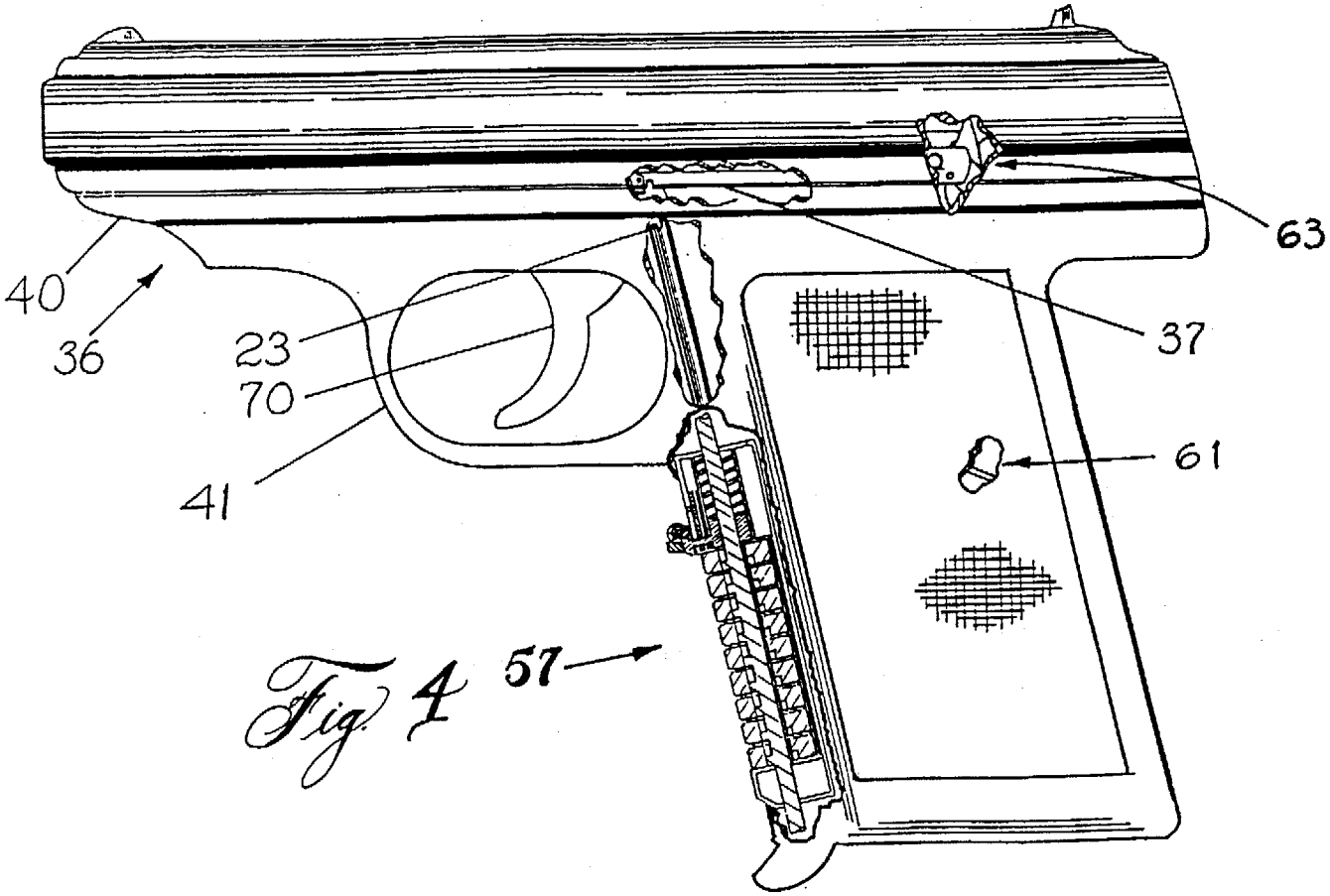
FIG. 4 is a cross section cut away side view of a preferred combination lock installed on a semi-automatic pistol.

The preferred combination lock assembly (57) as described above and shown in FIGS. 3,4, and 5 are to block the movement of the trigger draw bar (37) of a certain pistol (36). The combination lock assembly (57) is installed in the handle area (39) of the pistol (36) just below and to the rear of the trigger guard (41) parallel to and abutting the magazine (61). By installing the unit here it can be totally operated by the fingers and thumb of the same hand that fires the weapon (36). The preferred invention (57) can also be modified to fit in other sections of pistols of varying design to halt unauthorized firing.

Revolvers

The preferred combination lock assembly (57) effectively works for revolvers (45) as shown in FIGS. 8 and 10. The same concept and operational procedure is followed for revolver (45) installations as with the preferred assembly (57) for pistols (36) with a few minor adaptations in design. With a convenient location on most revolvers (45) also being in the handle (39) area, the preferred invention (57) can be installed to immoblize the hammer (47) instead of a trigger draw bar (37). This can be accomplished by blocking the hammer spring assembly (38), as seen in FIG. 10. It can also be done by extending the plunger rod member (4) with an attached blocking member (23) to block the hammer (47) itself. Referring to FIG. 10, the preferred combination lock (57) is located in the mid section of the handle area (39) to block the hammer spring rod (48).

Limited space might require the invention to be installed without the invention housing (12). For example, on certain revolvers (45) a preferred locking assembly (57) can be installed in an area (not shown) directly above the handle (39) on the gun frame (40). This installation would be to block the hammer (47) directly. Special attachment members (15) that secure the slotted support member (3) directly to the gun frame (not shown) can preform the same function as the invention housing (12).

Revolver handles (39) are easily detachable by removing the handle's (39) fastening means (50) which usually consists of one attachment screw. Therefore, a tamper retardant member (49) is attached to the plunger rod and set to lock the existing fastening means (50) of the firearm engageable with the said fastening means (50) when the preferred locking means assembly (57) is in the "on safety" position (30). This is shown in FIG. 10.

Shotguns, Rifles and Assault Weapons

The preferred invention assembly (57) will work on these types of weapons in the same way as outlined above for pistols (36) and revolvers (45). The obvious difference in these installations will be in the placement and linkage. On most of these weapons, the preferred invention assembly (57) will will usually be placed horizontally ahead of, above, or behind the trigger group (81) to block movement of the trigger (70). They can also be installed to block the gun's hammer (47) as well. Other installations are placed horizontally in front of the trigger guards (41) in order to control the existing safeties (46). Of course, there will be many types of weapons that will require a custon installation.

I claim:

1. A combination safety locking arrangement for selectively disabling a firearm, the firearm having a barrel, a trigger and a hammer, whereas the hammer, in an unlocked position, being mechanically movable into a functional position for causing the firing of a projectile and in the locked position being mechanically immovable prohibiting the hammer to move causing the firing of a projectile, said combination locking arrangement comprising:

a. a movable plunger rod member inserted through a plurality arrangement of cam rollers;

b. a blocking engagement member governed by said plunger rod member engageable with the firing mechanism of said firearm functional to effectively block said firing mechanism;

c. a control member adapted to sustain said movable plunger rod member providing means to move said movable plunger rod member from the engaged position to the unengaged position and from the said unengaged position to the said engaged position.

2. The combination safety locking arrangement for firearms as claimed in claim 1, further comprising: an elastic member that provides a force against a movable plunger rod member in the locking motion of said movable plunger rod member and provides an elastic force in the direction of the unlocking motion.

3. A combination firearm locking arrangement for selectively disabling a firearm, the firearm having a barrel, a trigger and a hammer, the hammer, in an unlocked position, being mechanically movable into a functional position for causing the firing of the firearm and in a locked position being mechanically immovable thereby unable to fire said firearm, said combination firearm locking arrangement comprising:

a. a movable plunger rod member inserted through a plurality arrangement of cam rollers;

b. a blocking member governed by said movable plunger rod member engageable with the firing mechanism of a firearm functional to effectively block said firing mechanism;

c. a control member adapted to sustain said movable plunger rod member providing means to move said movable plunger rod member from an unengaged position to an engaged position and from said engaged position to said unengaged position;

d. said cam rollers each having known perpendicular cadence markings different in peripheral structure than the remainder of the peripheral structure of said cam rollers, uniformly separating said indicia spaces;

e. one reference marking placed on the peripheral surface of each of the said cam rollers whereby authorized user can establish beginning of rotational sequence;

f. an elastic member abutting each of the said cam rollers that provides sufficient force to cause a variance in the rotational movement of said cam rollers when coming in contact with said cadence and reference markings.

4. A combination firearm locking arrangement for selectively disarming a firearm, the firearm having a barrel, a trigger, and a hammer, the hammer in an unlocked position, being mechanically movable into a functional position for causing the firing of a projectile and in the locked position being mechanically immovable prohibiting the hammer to move causing the firing of a projectile, said combination locking arrangement comprising:

a. a movable plunger rod member inserted through a plurality arrangement of cam rollers;

b. said movable plunger rod member governing a blocking engagement member engageable with the firing mechanism of said firearm functional to effectively block said firing mechanism;

c. a control member adapted to sustain said movable plunger rod member providing means to move said movable plunger rod member from the engaged position to the unengaged position and from the unengaged position to the said engaged position;

d. a catch member functional to engage said movable plunger rod member into a locked position;

e. a secure member adapted to said catch member to effectively lock said movable plunger rod member in a position to effectively block a firing mechanism of a firearm and to effectively allow said movable plunger rod member to assume a position that allows firing the firearm.

5. A combination safety locking arrangement for selectively disabling a firearm, the firearm having a barrel, a trigger, and a hammer, whereby the hammer, in an unlocked position, being mechanically movable into a functional position for causing the firing of a projectile and in the locked position being mechanically immovable prohibiting the hammer to move causing the firing of a projectile, said combination locking arrangement comprising:

a. a movable plunger rod member inserted through an plurality arrangement of cam rollers;

b. said movable plunger rod member governing a blocking member engageable with the firing mechanism of said firearm functional to effectively block said firing mechanism;

c. a control member adapted to sustain said movable plunger rod member providing means to move said movable plunger rod member from the engaged position to the unengaged position and from the said unengaged position to the said engaged position;

d. a cam roller resistance system providing means to selectively restrain rotational movement of any selection of said individual cam rollers of said combination safety locking arrangement.

6. A combination safety locking arrangement for selectively disabling a firearm, the firearm having a barrel, a trigger, and a hammer, whereby said hammer, in an unlocked position, being mechanically movable into an actuable position for causing the firing of a projectile and in the locked position being mechanically immovable prohibiting said hammer to move causing the firing of a projectile, said combination safety locking arrangement comprising:

a. a movable plunger rod member inserted through an plurality arrangement of cam rollers;

b. a blocking member governed by said plunger rod member engageable with the firing mechanism of said firearm functional in the locked position to effectively block said firing mechanism;

c. a control member adapted to sustain said movable plunger rod member thereby providing means to move said plunger rod member from the engaged position to the unengaged position and from the unengaged position to the engaged position;

d. a tamper proof system functional to engage said movable plunger rod member with said firearm while in the said locked position thereby prohibiting access to said combination firearm locking arrangement and while in the said unlocked position allowing access to the said combination firearm locking arrangement.

7. A combination safety locking arrangement as claimed in claim 2, further characterized by a slidingly movable cover member horizontally movable to effectively shield said combination safety locking arrangement.

* * * * *